US005335611A

United States Patent [19]

Freermann

[11] Patent Number: 5,335,611

[45] Date of Patent: Aug. 9, 1994

[54] EDGE GUIDE FOR A TEXTILE WEB

[75] Inventor: Johannes Freermann, Ochtrup, Fed. Rep. of Germany

[73] Assignee: Carl Schmale GmbH & Co. KG, Ochtrup, Fed. Rep. of Germany

[21] Appl. No.: 859,301

[22] PCT Filed: Nov. 27, 1990

[86] PCT No.: PCT/DE90/00911

§ 371 Date: May 19, 1992

§ 102(e) Date: May 19, 1992

[87] PCT Pub. No.: WO91/08334

PCT Pub. Date: Jun. 13, 1991

[30] Foreign Application Priority Data

Dec. 2, 1989 [DE] Fed. Rep. of Germany ... 8914223[U]

[51] Int. Cl.[5] ..... D05B 35/10; D05B 37/08; D05B 27/00

[52] U.S. Cl. ..... 112/153; 112/141; 112/304; 83/14

[58] Field of Search ..... 112/121.15, 121.12, 112/121.11, 304, 303, 262.3, 147, 141, 153, 155, 2; 271/10, 13, 264; 83/14, 78, 109

[56] References Cited

U.S. PATENT DOCUMENTS

| | | | |
|---|---|---|---|
| 3,934,525 | 1/1976 | Alfred | 112/147 X |
| 4,573,420 | 3/1986 | Carson | 112/147 X |
| 4,856,439 | 8/1989 | O'Neal | 112/121.15 X |
| 5,018,416 | 5/1991 | Freermann | 112/121.15 X |
| 5,133,273 | 7/1992 | Brocklehurst | 112/141 X |

*Primary Examiner*—Peter Nerbun
*Attorney, Agent, or Firm*—Herbert Dubno

[57] ABSTRACT

A sewing machine includes two machine halves spaced from one another and each provided with respective tongues capable of displacing pieces of the material web previously cut into pieces on a conveyor, the conveyor being provided with guide rails, one of the rails being formed with a starting portion inclined along and transverse to a travel direction of the conveyor, so that each of the pieces of the web received by the conveyor is delivered to a sewing machine with respective longitudinal edges bent upwardly with respect to a main portion of the web, preventing thereby unraveling the weft upon cutting the web by inherent gravity forces.

1 Claim, 5 Drawing Sheets

EDGE GUIDE FOR A TEXTILE WEB

CROSS REFERENCE TO RELATED APPLICATION

This application is a national phase application of PCT/DE90/00911 filed and based upon a German Application filed under the International Convention.

FIELD OF THE INVENTION

The invention relates to an edge guide for a textile web in a sewing installation for the automatic finishing of textile products with trimmed ends, wherein the textile web is wound on a cloth beam.

BACKGROUND OF THE INVENTION

A sewing installation of this type is the object of German Patent 37 10 025. This sewing installation has proven to be most efficient in the automatic production of textile products with finished ends, whereby it is particularly advantageous that several webs can be taken up at the same time from the cloth beam. However, it has been found that in the processing of coarse goods with thick weft threads, such as used particularly in scouring cloth, difficulties arise because of the tendency of the weft threads to detach themselves from the fabric, so that the edges can not be perfectly finished.

OBJECTS OF THE INVENTION

It is the object of the invention to provide an apparatus for preventing the detachment of weft threads at the edge of textile products.

According to the invention an apparatus for cutting pieces from an elongated web, so that each of the pieces is formed with respective hemmed longitudinal sides, and for delivering the pieces toward a sewing machine, the apparatus comprising:

storing means including a cloth beam with a web wound thereon;

transport means receiving the web from the beam for transporting the web downstream along a web path in a first upstream-downstream direction; cutting means including a separator movable transversely to the first direction for cutting pieces from the web along the path;

an upstream machine half provided with respective pick-up means including respective tongue movable reciprocally parallel to the first direction and communicating with the separator for sequentially clamping the pieces of the web;

a downstream machine half spaced downstream of the upstream machine half along the web path and provided with respective pickup means including respective tongues movable reciprocally parallel to the first direction and communicating with the respective tongues of the upstream half for further advancing the pieces along the web path;

conveyor means including a longitudinal endless conveyor movable in a second upstream-downstream direction along a piece path transversely to the first direction and having a respective upstream part flanked by the machine halves, the conveyor receiving sequentially the pieces from the machine halves, the conveyor receiving sequentially the pieces from the tongues; and guiding means extending along the second direction substantially between the cutting means and the sewing machine for guiding respective longitudinal edges of each of the pieces transported by the conveyor, the guiding means being provided along opposite longitudinal flanks of the conveyor and including:

a pair of edged rails extending parallel to the conveyor, and a pair of abutment rails, each of the abutment rails being provided with a respective upstream portion inclined along and transversely to the second direction, so that respective longitudinal hemmed sides of each of the pieces are bent upwardly at a right angle with respect to a main portion of the web.

As a result of the steps taken by the invention, the thick weft threads at the edge of the textile product are prevented from leaving the bond of the fabric consisting of warp and weft. By raising the textile edge in a simple manner, perfectly neat edges result, a success which is achieved by surprisingly simple structure of the device according to the invention.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
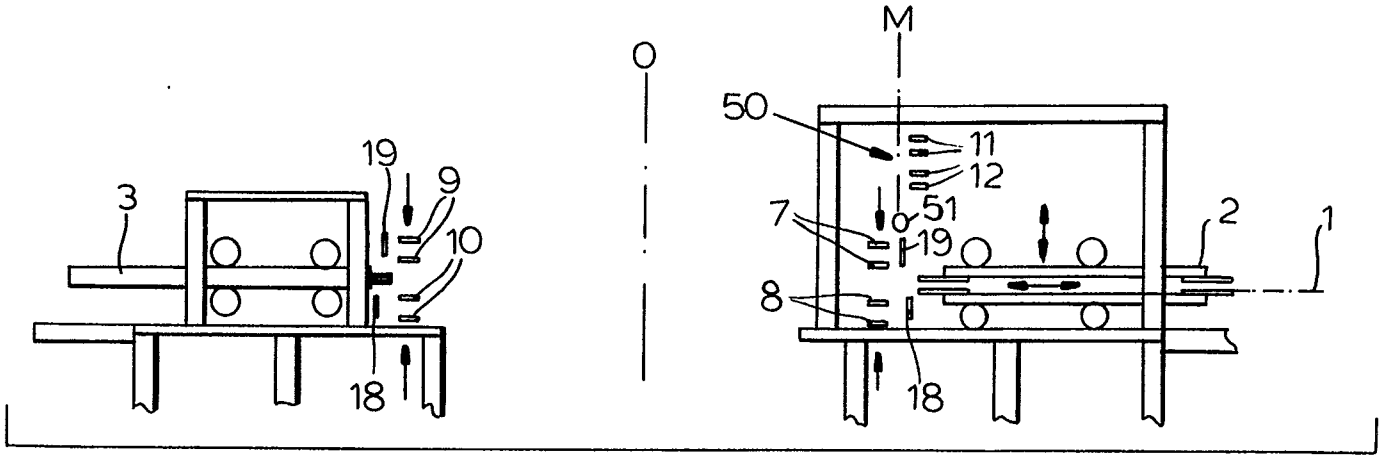
FIG. 1 is an end view of the right and the left machine halves I and II with the advance or pickup tongs.

FIG. 1 shows a lateral view of the right machine half I and the left machine half II. The textile web 1 coming from the cloth beam is taken up by the advance tong 2 and moved towards the machine middle o in a first conveying direction. Thereby the textile web 1 reaches the plane m of the cutting device 50 with its belt pairs 11, 12, which serve for the transport and driving of the disk cutter 51. On both sides of the machine middle o, clamping devices are provided and work in the direction of the longitudinal conveyor 14 in a direction perpendicular to the plane of paper and consist for instance of two belt pairs 7, 8 and 9, 10. Laterally with respect to the separating device the rails 18, 19 of the setting device 20 are shown. In the left machine half II one can discern the pickup tong 3, also the clamping device with the belt pairs 9, 10 and the rails 18, 19 of the setting device 20.

Figure 2:
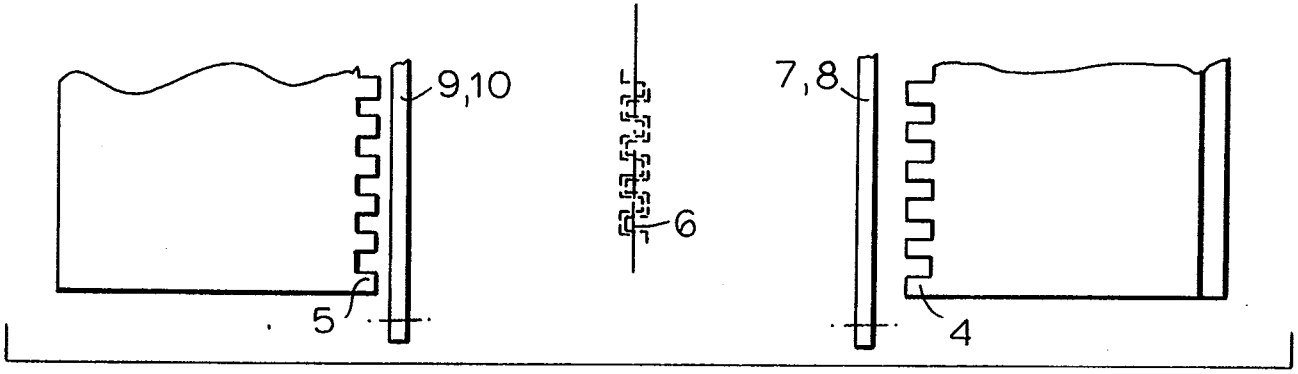
FIG. 2 is the right and the left machine halves with a top view of the tongs and the belts.

FIG. 2 shows a top view of the tongs 2, 3, with their fingers 4, 5 and the belt pairs 7, 8 and 9, 10, whereby the fingers 4, 5 engage each other at 6 in the machine middle o.

Figure 3A:
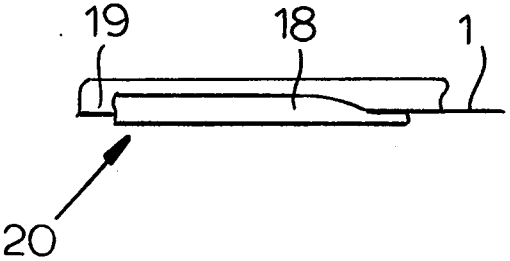
FIG. 3*a* is a lateral view of the setting device.
Figure 3:
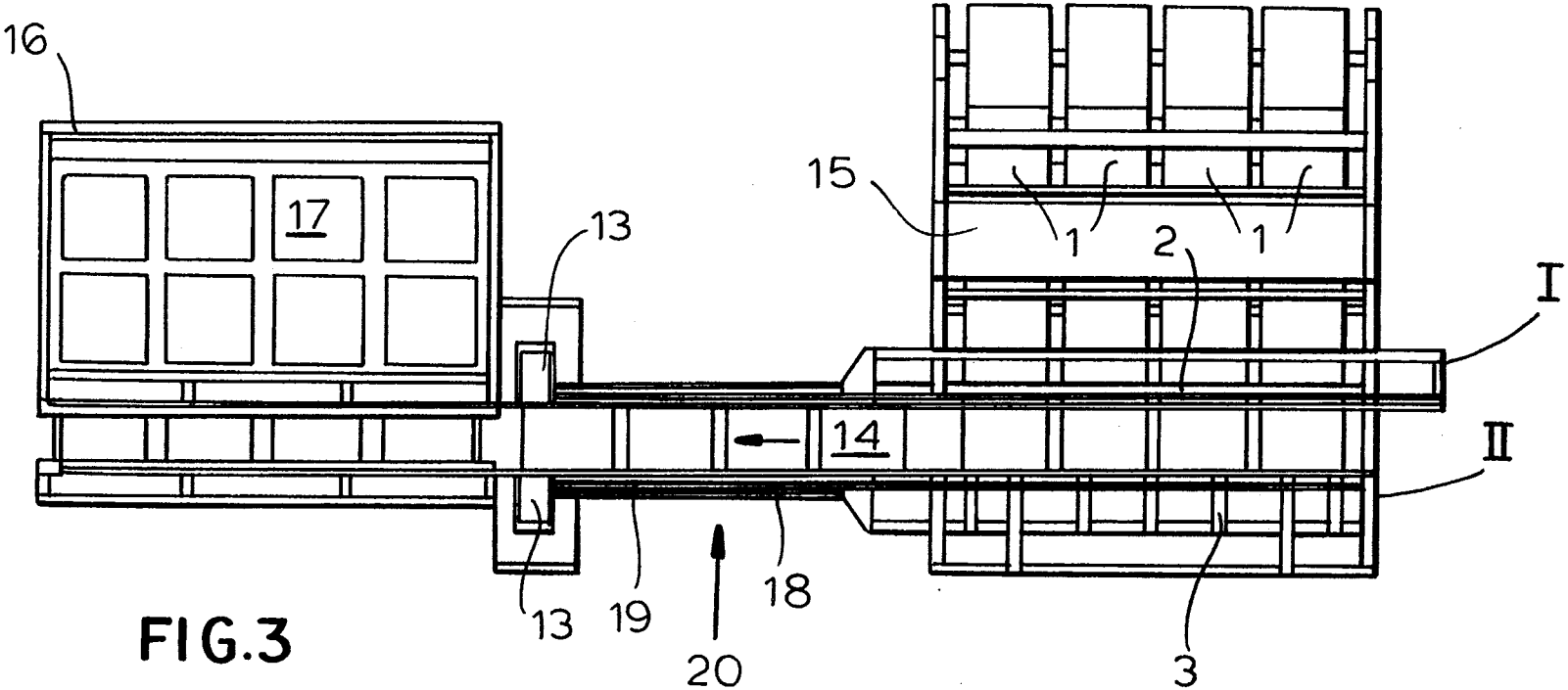
FIG. 3 is a general top view of the sewing installation with the setting device for the edges of the textile web.

FIG. 3 shows a top view of the general layout of the sewing installation. The textile web 1 is moved by both tongs 2, 3 in the first conveying direction to the machine middle o, where it is transferred to the longitudinal conveyor 14. The longitudinal conveyor 14 transports the textile web 1 in the direction of the arrow to the sewing machine 13, where it is hemmed and sewn. The setting device 20 is arranged on both sides of the longitudinal conveyor 14 supporting the textile products such as scouring cloth, namely between the left end—as shown in drawing—of the separating device and the sewing installation with the sewing machines 13. The setting device 20 consists respectively of an abutment rail 18 and an edged rail 19.

FIG. 3*a* is a lateral view of the setting device 20 with the textile web 1 running vertically with respect to the plane of the drawing and with the abutment rail 18 and the edged rail 19. The abutment rail 18 has at its beginning an inclined starting edge.

Figure 4:
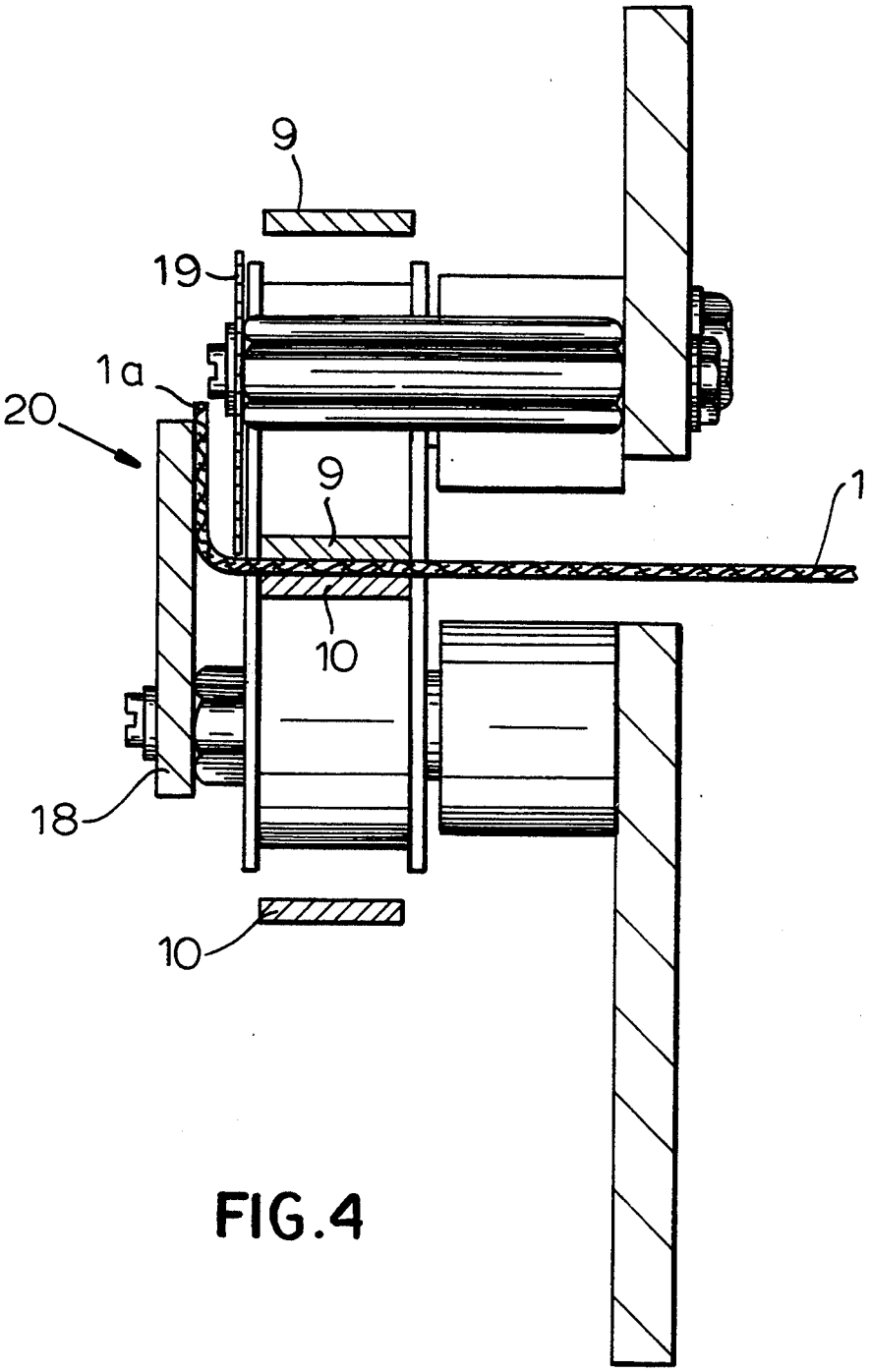
FIG. 4 is a detailed view of the setting device.

FIG. 4 shows a detailed view of the setting device 20. The textile web 1 is in a clamped position between the belts 9, 10. The edge of the textile web 1 is bent upwards (at 1*a*), in the area of the abutment rail 18. The abutment rail 18 is fastened to the side wall of the machine by spacers. The same applies to the edged rail 19.

Figure 5:
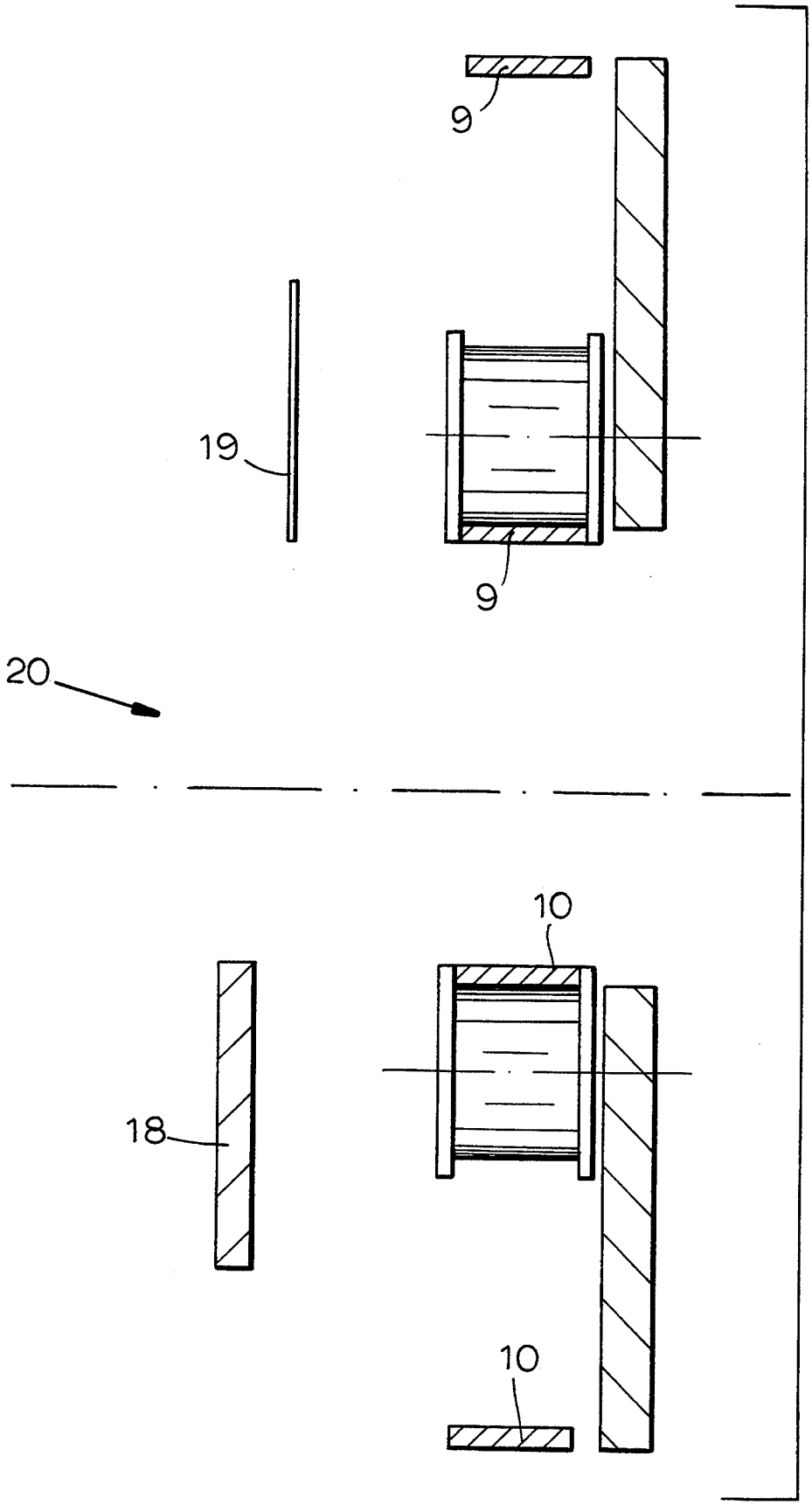
FIGS. 5 and 6 the cooperation of the clamping device for the textile web with the setting device.
Figure 6:
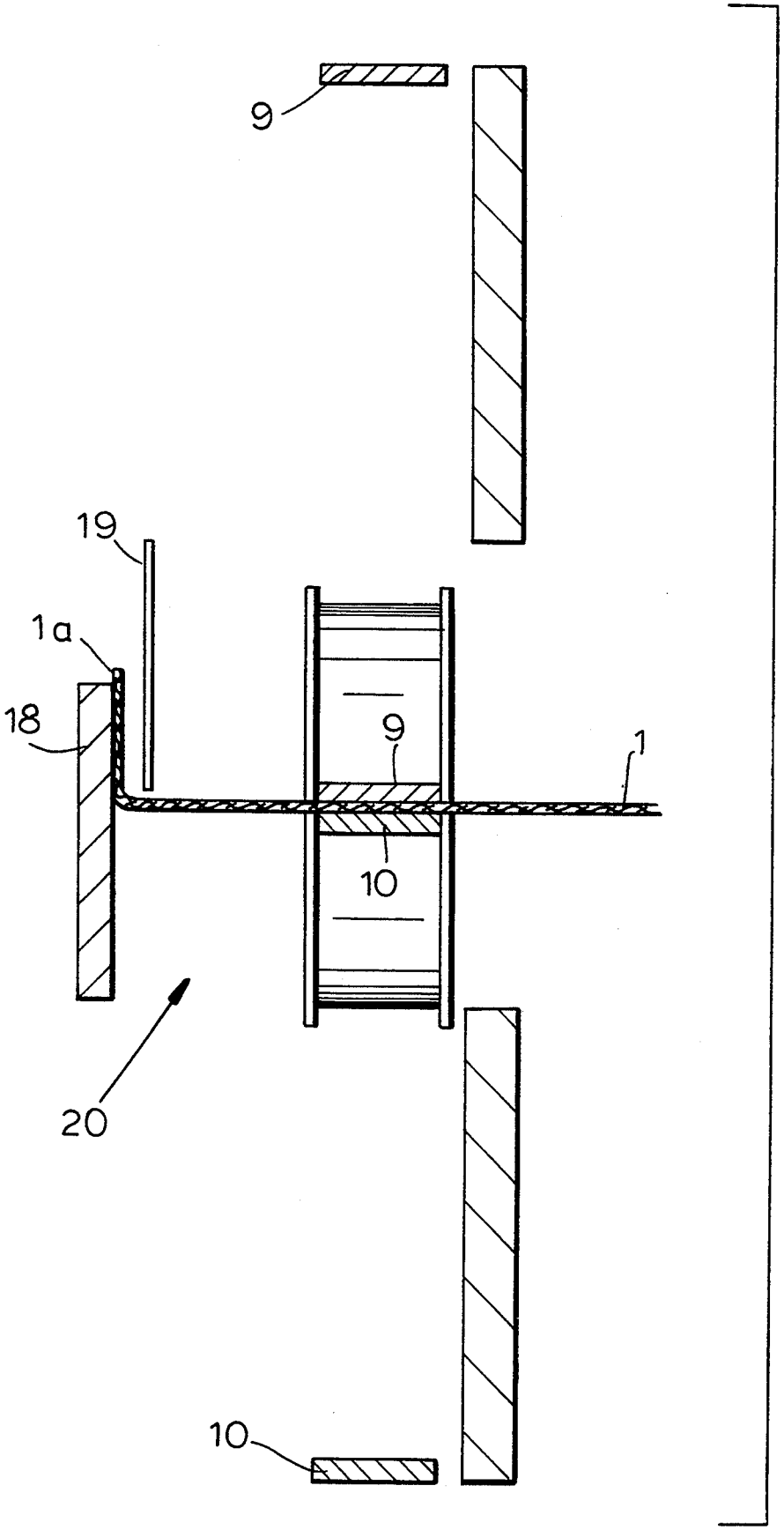

FIGS. 5 and 6 show the cooperation between the clamping device for instance at the belt pairs 9, 10 for the textile web 1 and the setting device 20. Thereby, the abutment rail 18 and the edged rail 19 participate in the up and down movement of the rollers causing the clamping action of the belts. FIG. 5 shows the open position, while FIG. 6 shows the clamping position, wherein the belts 9, 10 clamp down on the textile web 1 and both rails 18, 19 are in working position.

Advantageously, the edge guide according to the invention could be arranged already in the cutting station itself. Since the rigid rail 18 is lower than the bottom edge of the edged rail 19, the rail 18 can run through. The edged rail 19 can not fall all the way down, since it comes to rest against the rigid abutment rail 18.

I claim:

1. An apparatus for cutting pieces form an elongated web, so that each of said pieces is formed with respective hemmed longitudinal sides, and for delivering the pieces toward a sewing machine, said apparatus comprising:

storing means including a cloth beam with a web wound thereon;

transport means receiving the web from said web for transporting the web downstream along a web path in a first upstream-downstream direction;

cutting means including a separator movable transversely to said first direction for cutting pieces from said web along said path;

an upstream machine half provided with respective pickup means including respective tongues movable reciprocally parallel to said first direction and communicating with said separator for sequentially clamping said pieces of the web;

a downstream machine half spaced downstream of said upstream machine half along said web path and provided with respective pickup means including respective tongues movable reciprocally parallel to said first direction and communicating with the respective tongues of the upstream half for further advancing said pieces along said web path;

conveyor means including a longitudinal endless conveyor movable in a second upstream-downstream direction along a piece path transversely to said first direction and having a respective upstream part flanked by said machine halves, said conveyor receiving sequentially said pieces from said machine halves, said conveyor receiving sequentially said pieces from said tongues; and guiding means extending along said second direction substantially between said cutting means and the sewing machine for guiding respective longitudinal edges of each of said pieces transported by said conveyor, said guiding means being provided along opposite longitudinal flanks of said conveyor and including:

a pair of edged rails extending parallel to said conveyor, and a pair of abutment rails, each of said abutment rails being provided with a respective upstream portion inclined along and transversely to said second direction, so that respective longitudinal hemmed sides of each of said pieces are bent upwardly at a right angle with respect to a main portion of the web.

* * * * *